US007421743B1

(12) United States Patent
Wixom et al.

(10) Patent No.: US 7,421,743 B1
(45) Date of Patent: Sep. 9, 2008

(54) OSTOMY GARMENT APPARATUS

(76) Inventors: David V. Wixom, 429 Triple Crown Way, Grantsville, UT (US) 84029; Lynda K. Kelly, 429 Triple Crown Way, Grantsville, UT (US) 84029

( * ) Notice: Subject to any disclaimer, the term of this patent is extended or adjusted under 35 U.S.C. 154(b) by 0 days.

(21) Appl. No.: 11/846,692

(22) Filed: Aug. 29, 2007

(51) Int. Cl.
*A41D 13/00* (2006.01)
*A61M 31/00* (2006.01)
*A41B 9/00* (2006.01)
*A61M 32/00* (2006.01)

(52) U.S. Cl. ..... 2/114; 604/174; 604/179

(58) Field of Classification Search ..... 2/114, 2/69, 113, 115, 104, 105, 106, 48, 51, 52, 2/74, 75, 77, 109, 125; 604/174, 179, 345
See application file for complete search history.

(56) References Cited

U.S. PATENT DOCUMENTS 2,778,362 A * 1/1957 Pollock et al. ..... 604/345
3,421,505 A * 1/1969 Freeman et al. ..... 604/345
4,533,355 A 8/1985 Fair
4,888,006 A 12/1989 Beaupied
5,142,702 A 9/1992 Piloian
D384,487 S 10/1997 Ingels
5,806,096 A * 9/1998 Pennington ..... 2/80
5,843,053 A * 12/1998 Steer ..... 604/342
5,946,722 A * 9/1999 Trautmann ..... 2/83
5,991,923 A * 11/1999 Maria ..... 2/83
6,032,289 A * 3/2000 Villapiano ..... 2/102
6,202,222 B1 3/2001 Robbins
6,468,254 B2 10/2002 Gupton
6,477,710 B1 * 11/2002 Ojoyeyi ..... 2/69
6,840,924 B2 * 1/2005 Buglino et al. ..... 604/337
7,313,832 B2 * 1/2008 Worsoee ..... 2/400

* cited by examiner

*Primary Examiner*—Gloria Hale

(57) ABSTRACT

An ostomy garment apparatus includes a shirt with a front wall, a back wall and a pair of sleeves attached together. An upper end of the shirt has a neck opening therein. A bottom end of the shirt has a torso opening extending therein. An aperture for receiving a tube extends through the front wall. The aperture is positioned nearer to the torso opening than the neck opening. A resiliently stretchable band is attached to and is coextensive with a perimeter edge of the aperture.

2 Claims, 3 Drawing Sheets

OSTOMY GARMENT APPARATUS

BACKGROUND OF THE INVENTION

Field of the Invention

The present invention relates to ostomy garment devices and more particularly pertains to a new ostomy garment device for allowing access to an ostomy tube through a garment.

SUMMARY OF THE INVENTION

The present invention meets the needs presented above by generally comprising a shirt with a front wall, a back wall and a pair of sleeves attached together. An upper end of the shirt has a neck opening therein. A bottom end of the shirt has a torso opening extending therein. An aperture for receiving a tube extends through the front wall. The aperture is positioned nearer to the torso opening than the neck opening. A resiliently stretchable band is attached to and is coextensive with a perimeter edge of the aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
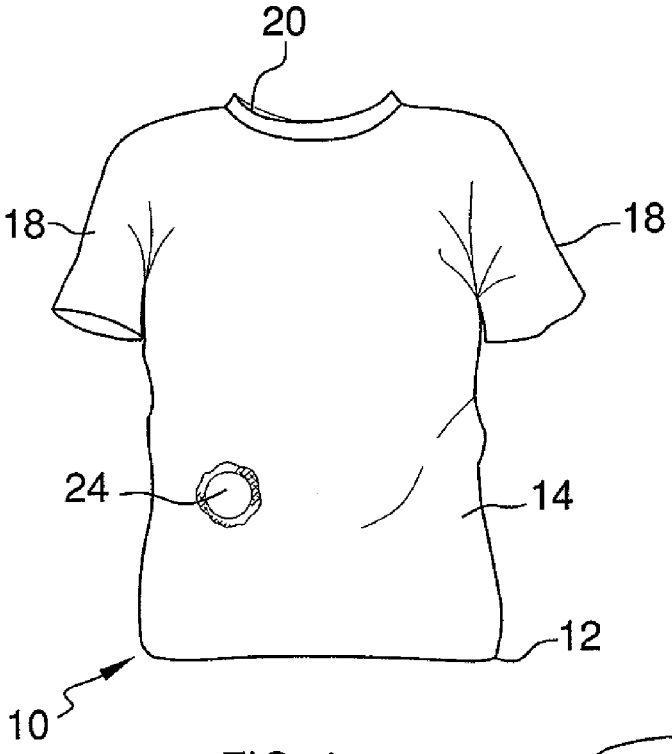
FIG. 1 is a front view of an ostomy garment apparatus according to the present invention.
Figure 2:
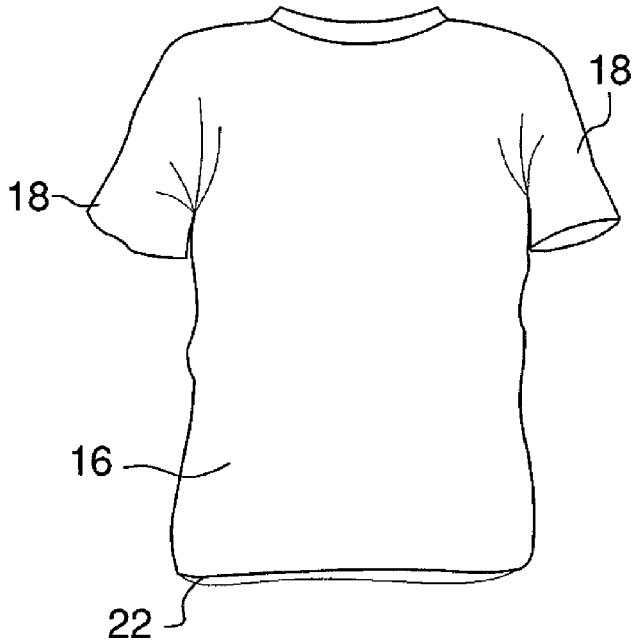
FIG. 2 is a back view of the present invention.
Figure 3:
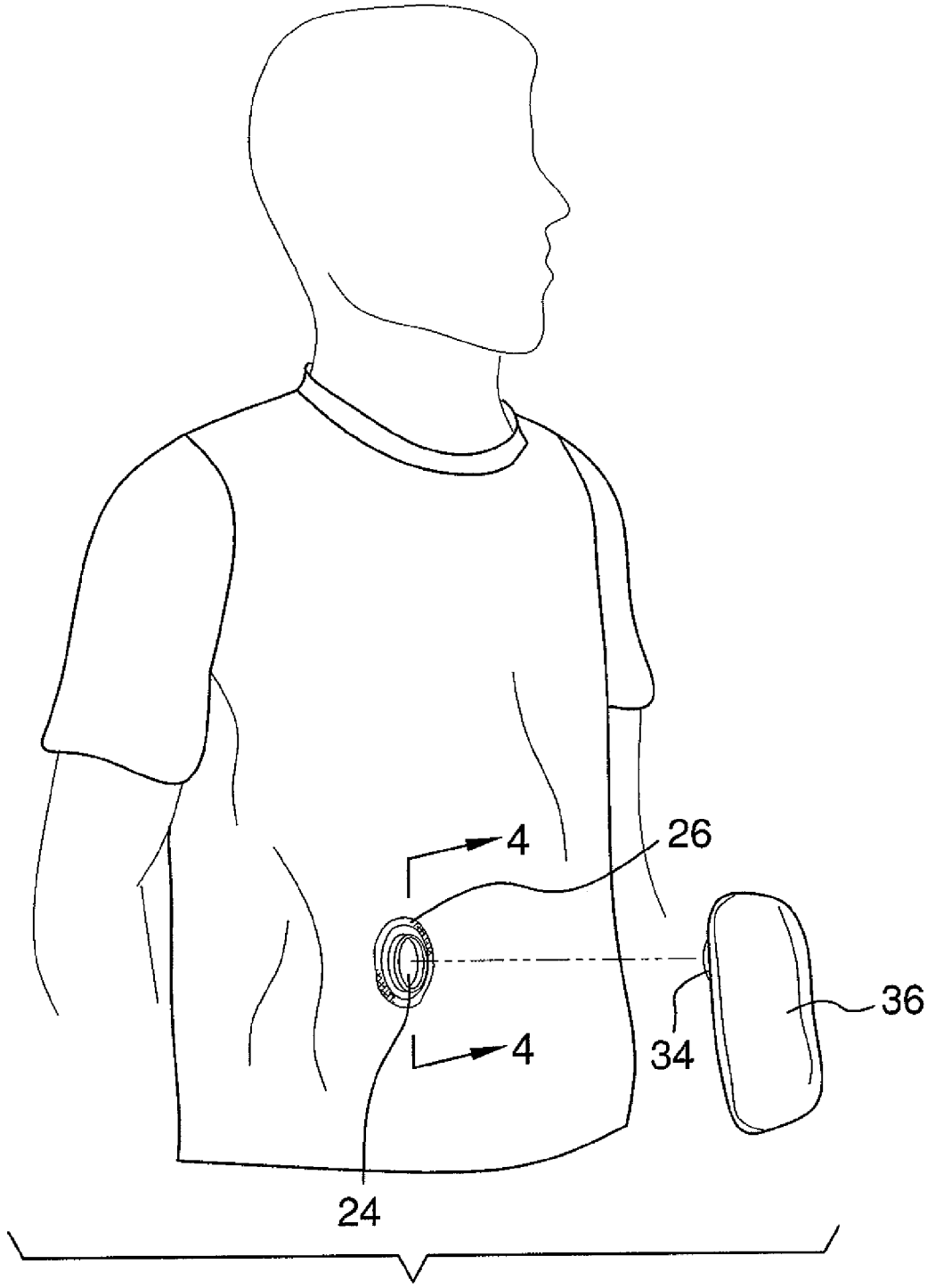
FIG. 3 is a perspective in-use view of the present invention.
Figure 4:
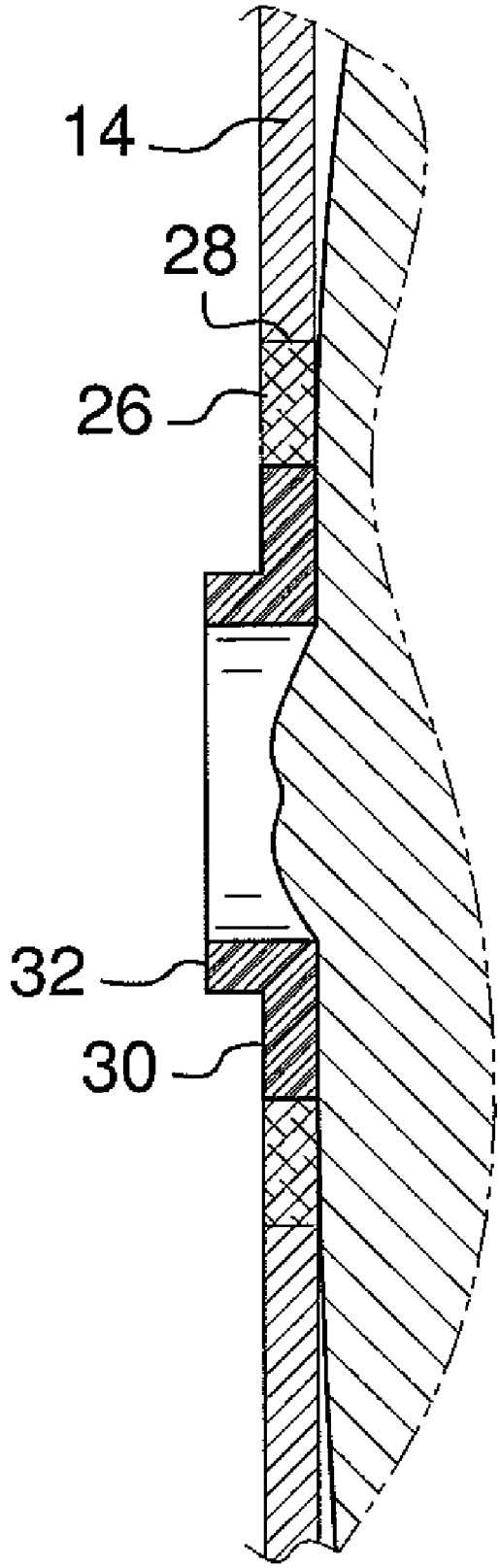
FIG. 4 is a cross-sectional view taken along line 4-4 of FIG. 3 of the present invention.

With reference now to the drawings, and in particular to FIGS. 1 through 4 thereof, a new ostomy garment device embodying the principles and concepts of the present invention and generally designated by the reference numeral 10 will be described.

As best illustrated in FIGS. 1 through 4, the ostomy garment apparatus 10 generally comprises a shirt 12 with a front wall 14, a back wall 16 and a pair of sleeves 18 attached together. An upper end of the shirt 12 has a neck opening 20 therein and a bottom end of the shirt has a torso opening 22 extending therein. An aperture 24 for receiving a tube extends through the front wall 14. The aperture 24 is positioned nearer to the torso opening 22 than the neck opening 20. The shirt 12 is comprised of a conventional cloth material.

A resiliently stretchable band 26 is attached to and is coextensive with a perimeter edge 28 of the aperture 24. The resiliently stretchable material may comprise an elastomeric material. A ring 30 is coupled to and is coextensive with the band 26. The band 26 is positioned between the ring 30 and the perimeter edge 28 of the aperture 24. A flange 32 is attached and is coextensive with an inner peripheral edge of the ring 30. The flange 32 extends outwardly of the shirt 12 and away from the back wall 16. The band 26 allows movement of the ring 30 with respect with respect to the shirt 12 and may be used without the ring 30 to secure a tube in the aperture 24.

In use, a tube 34, such as that attached to an ostomy collection type bag 36, is extended through the aperture 24 for easy access to an ostomy tube of a person. The shirt 12 provides easy access without having to lift the shirt up.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An upper body garment apparatus for receiving an ostomy tube, said apparatus comprising:

a shirt with a front wall, a back wall and a pair of sleeves attached together, an upper end of the shirt having a neck opening therein, a bottom end of the shirt having a torso opening extending therein, an aperture for receiving a tube extending through said front wall, said aperture being positioned nearer to said torso opening than said neck opening; and a resiliently stretchable band being attached to and being coextensive with a perimeter edge of said aperture; and a ring being coupled to and being coextensive with said band, said band being positioned between said ring and said perimeter edge of said aperture.

2. An upper body garment apparatus for receiving an ostomy tube, said apparatus comprising:

a shirt with a front wall, a back wall and a pair of sleeves attached together, an upper end of the shirt having a neck opening therein, a bottom end of the shirt having a torso opening extending therein, an aperture for receiving a tube extending through said front wall, said aperture being positioned nearer to said torso opening than said neck opening;

a resiliently stretchable band being attached to and being coextensive with a perimeter edge of said aperture;

a ring being coupled to and being coextensive with said band, said band being positioned between said ring and said perimeter edge of said aperture; and a flange being attached and being coextensive with an inner peripheral edge of said ring, said flange extending outwardly of said shirt and away from said back wall.

* * * * *